US006053479A

United States Patent [19]

Lang et al.

[11] Patent Number: 6,053,479

[45] Date of Patent: Apr. 25, 2000

[54] SELF-ALIGNING VORTEX SNOW FENCE

[75] Inventors: Renee M. Lang, Gig Harzone, Wash.; George L. Blaisdell, Cornish, N.H.

[73] Assignee: The United States of America as represented by the Secretary of the Army, Washington, D.C.

[21] Appl. No.: 09/105,010

[22] Filed: Jun. 26, 1998

[51] Int. Cl.[7] ..... E04H 17/00

[52] U.S. Cl. ..... 256/12.5; 256/1

[58] Field of Search ..... 256/12.5–24, 26; 244/199

[56] References Cited

U.S. PATENT DOCUMENTS

| | | | |
|---|---|---|---|
| 490,545 | 1/1893 | Dixson . | |
| 1,026,806 | 5/1912 | Iblings | 256/12.5 X |
| 1,108,943 | 9/1914 | Swezey . | |
| 1,144,393 | 6/1915 | Swezey | 256/12.5 |
| 1,523,995 | 1/1925 | Naud . | |
| 1,709,787 | 4/1929 | Glanzer . | |
| 2,095,520 | 10/1937 | Fugit . | |
| 3,226,091 | 12/1965 | Root . | |
| 3,473,786 | 10/1969 | Luebke . | |
| 3,797,787 | 3/1974 | Watanabe et al. | 256/24 X |
| 3,966,172 | 6/1976 | Garrett . | |
| 4,339,114 | 7/1982 | Deike . | |
| 4,529,173 | 7/1985 | Kramer et al. . | |
| 4,549,724 | 10/1985 | Taillandier . | |
| 4,671,495 | 6/1987 | Garland et al. . | |
| 4,958,806 | 9/1990 | Sato et al. . | |
| 5,598,990 | 2/1997 | Farokhi et al. | 244/199 |
| 5,772,155 | 6/1998 | Nowak | 244/199 |

FOREIGN PATENT DOCUMENTS

| | | | |
|---|---|---|---|
| 3222324 | 12/1983 | Germany | 256/12.5 |

*Primary Examiner*—Harry C. Kim
*Attorney, Agent, or Firm*—Luther A. Marsh

[57] ABSTRACT

The invention relates to a passive snow removal system which deliberately forms vortices from a passing airflow and directs the vortices into scouring contact with snow accumulation on a target surface. The apparatus includes a base and a vortex producing plate rotatably mounted at an inclined angle relative to an upper portion of the base near the plate's center of mass. The geometry of the plate, which is preferably triangular, is used to aerodynamically form vortices from a passing airflow and direct the vortices onto a target surface. Once the vortices are in scouring contact with the target surface, they act upon the surface to dislodge and carry away any accumulated snow in the direction of the airflow and redeposit it downwind, thus removing the snow from the target surface.

6 Claims, 3 Drawing Sheets

SELF-ALIGNING VORTEX SNOW FENCE

BACKGROUND OF THE INVENTION

The present invention relates to a snow removal apparatus, and more particularly to a self-aligning vortex snow fence for reducing or eliminating snow accumulation in targeted areas of concern.

Snow drift accumulation can be problematic in areas where people, animals, and vehicles must operate. A deep snow accumulation reduces mobility by requiring an increase in the energy expenditures normally required to carry out the same tasks. If the snow accumulation is severe enough it can halt normal operations altogether. Increased loading due to snow drifting can threaten infrastructure and cause collapse of roof tops. The safety of the aircraft and motor vehicles can be compromised by drifts on runways and roads. Snow cornice formation on overhanging steep terrain can create an avalanche danger to individuals and towns.

The self-aligning vortex fence is designed specifically to be a passive snow removal device. Compared to snow plows, snow blowers, and other mechanical devices, the self-aligning vortex snow fence is far more efficient since it requires no operator, no fuel expenditure, and no sophisticated equipment. The self-aligning vortex snow fence completely removes snow from areas, unlike some other schemes where the snow is encouraged to melt in place. Inexpensive and efficient removal of snow is therefore useful anywhere annual snowfall threatens to limit mobility or the safety of the local population.

BRIEF DESCRIPTION OF THE PRIOR ART

Currently, there are several techniques and devices for the removal of snow. A type of snow fence called a jet roof or blower fence has been in use for some time for localized snow removal (scour) in alpine regions as disclosed by Montagne, J., McPartland, J. M., Super, A. B. and Townes, H. W., *Nature and Control of Snow Cornices on the Bridger Range, Southwestern Montana*, USDA Forest Service, Misc. Rep. No. 14, (1968) 23 p. These blower fences have always been fixed in orientation. Blower fences scour snow by causing increased wind velocity on the leeward side as the wind passes through what amounts to be a funnel formed by an inclined fence surface. Small vortices may occasionally be formed by a blower fence, but they are not what scours the snow behind the fence. One prior mention of a vortex generator for snow removal is in Meroney, B. N. and Meroney, R. N., *Snow Control with Vortex and Blower Fences*, USA CRREL Spec. Rep. 89-6, Int. Conf. on Snow Eng., 1st, Santa Barbara, Calif., Jul. 10–15, 1988, p. 286–296. As disclosed therein, a fixed position, scale model vortex snow fence was tested in a wind tunnel with sand. It has also been suggested to use vortex fences to increase the velocity of wind entering windmills, to use vortex generators to mix and dilute hazardous gases and to study sand scour behind a suspended wing.

The use of deliberately formed and controlled vortices to remove snow build up has not been demonstrated previously in the snow removal art. Typical snow fences in the prior art have been designed to trap snow and not to remove it as evidenced by the patent to Garrett U.S. Pat. No. 3,966,172. The patent to Taillandier U.S. Pat. No. 4,549,724 discloses a self-orienting barrier fence for use in controlling snow or sand drifts which is rotatably mounted on a support in such a manner that it will automatically direct itself into a position perpendicular to the wind direction. However, the patent fails to disclose the use of vortices to scour snow build-up. The self-aligning feature of the present invention allows the vortex fence to remove snow from a much larger area than fixed fences. The self-aligning vortex fence is capable of removing snow from an area of more than 500 times the planar area of the fence when moderate winds prevail.

SUMMARY OF THE INVENTION

Accordingly, the primary object of the present invention is to provide a passive snow removal system which deliberately forms and controls vortices to remove snow from a target surface. The apparatus includes a base and a vortex producing plate rotatably mounted at an inclined angle relative to the upper portion of the base near the plate's center of mass. The geometry of the plate, which is generally triangular in shape, is used to aerodynamically form vortices out of a passing airflow and direct the vortices onto a target surface. Once the vortices are in scouring contact with the target surface, they act upon the surface to dislodge and carry away any accumulated snow in the direction of the airflow and redeposit it downwind.

It is another object of the invention to provide snow removal apparatus that is designed to be a passive snow removal device that is far more efficient than current mechanical snow removal devices since it requires no operator, no fuel expenditure, no sophisticated equipment, and low maintenance due in part to the fact that the system has few moving or mechanical components.

BRIEF DESCRIPTION OF THE FIGURES

Other objects and advantages of the invention will become apparent from a study of the following specification when viewed in light of the accompanied drawings, in which.

DETAILED DESCRIPTION

Figure 1:
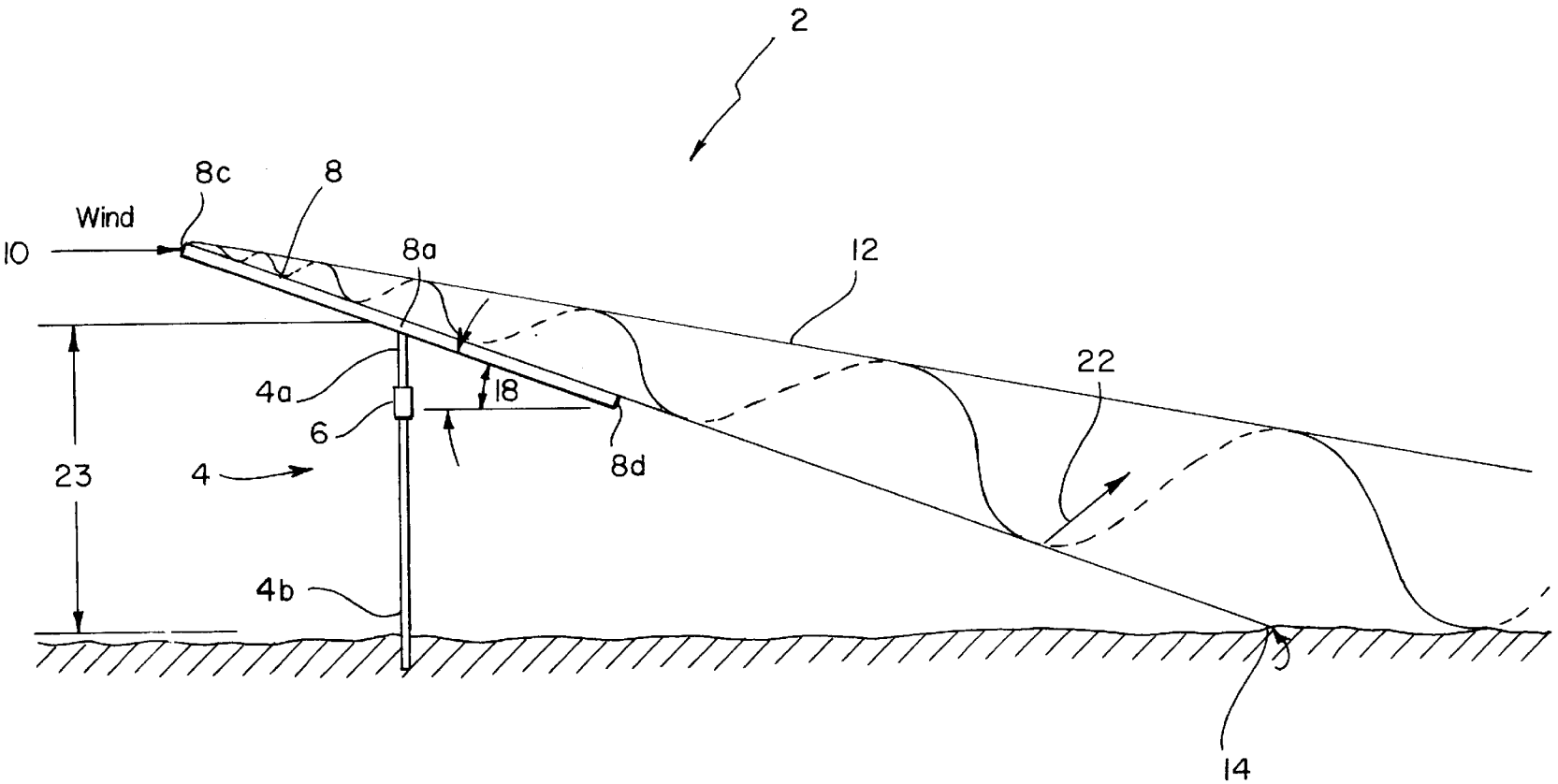
FIG. 1 is a side plan view of the snow removal apparatus according to the invention.

Referring now to FIG. 1, there is shown the snow fence apparatus 2 according to the invention. The apparatus includes a base or pole 4 having an upper portion 4*a* that is rotatably connected with a lower portion 4*b* by a swivel 6, so that the upper portion 4*a* may be freely rotated 360° about a vertical axis. The lower portion 4*b* is adapted to be fixedly secured in a snow or earth surface.

The snow fence apparatus 2 further includes a vortex producing plate 8 mounted on the rotating upper portion 4*a* of the base 4 for creating a vortex 12 from a passing airflow and directing the vortex towards a target surface 14. Preferably, the plate 8 is connected with the upper portion 4*a* at a location near the center of mass 8*a* of the plate. The plate 8 is constructed of a rigid material having a thickness which is minor relative to its other dimensions.

Figure 2:
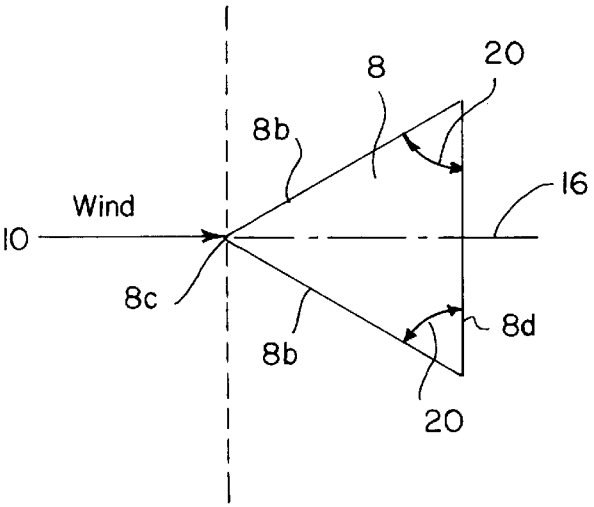
FIG. 2 is a top view of the triangular shaped vortex producing plate according to the invention.
Figure 4:
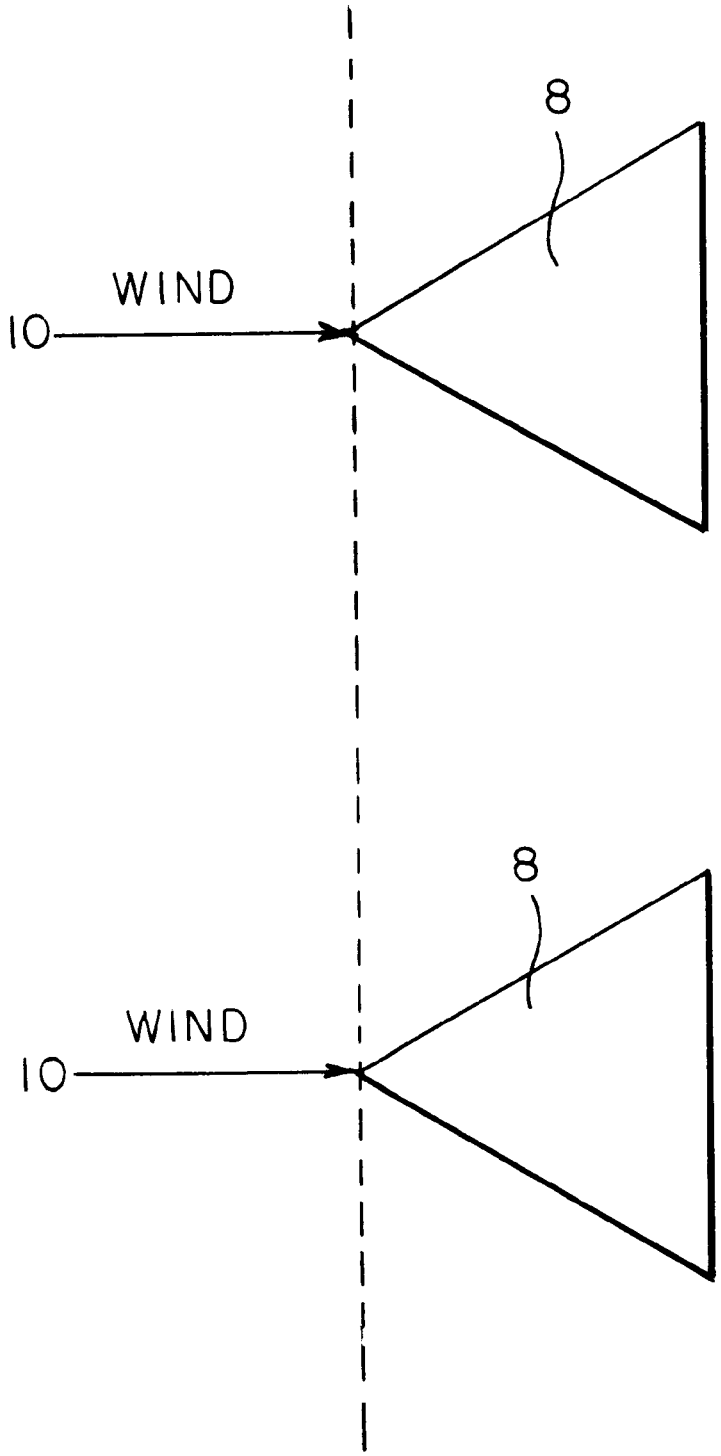
FIG. 4 is a top view of a plurality of the triangular shaped vortex producing plates according to the invention.

As shown in FIG. 2, the plate 8 is triangular in shape and further includes two leading edges 8*b*, a leading point 8*c* that is formed by the intersection of the leading edges 8*b*, and a trailing edge 8*d*. The plate should be symmetric about a midline 16, thereby requiring that the two leading edges 8*b* be of equal lengths. In one embodiment, the plate 8 is an equilateral triangle. While the proportions of the plate may be varied, the trailing edge angles 20 should not be an angle of less than 60°. Also, FIG. 4 shows a plurality of the self-aligning vortex snow fences which are selectively positioned to produce a plurality of vortices thereby removing snow from a larger target area.

Referring back to FIG. 1, the triangular plate 8 is connected with the base 4 at an angle of attack 18, which is a slight inclination from perpendicular to the base, so that the leading point 8*c* is at a higher elevation than the trailing edge 8*d*. Preferably the angle of attack 18 is between 5–25°. The inclination assists in keeping the leading point 8*c* of the plate 8 heading directly into the wind by utilizing the prevailing winds to aerodynamically operate on the inclined plate 8 and create pressure on the underside of the trailing edge, thereby causing the plate 8 to rotate accordingly.

Figure 3:
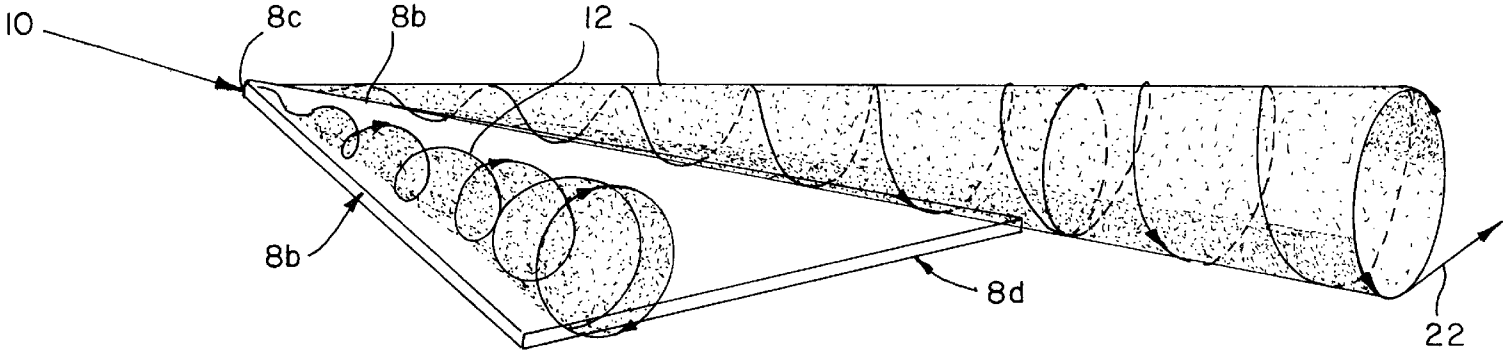
FIG. 3 is a detailed view of the vortex producing plate and the resulting vortices according to the invention.

As shown in FIG. 3, as an airflow 10 passes over the plate 8, a vortex 12 is formed along each of the leading edges 8*b*. Each vortex 12 originates at the leading point 8*c* and propagates along each of the leading edges 8*b* rearward towards the trailing edge 8*d*. The vortices 12 continue to travel past the trailing edge 8*d* in the direction of the airflow 10 until coming into scouring contact with the target surface 14. The size, strength, and persistence range of the vortices 12 are a function of the speed of the airflow 10, angle of attack 18 of the plate 8, the size and geometry of the plate 8, and the elevation of the plate from the snow's surface 23 (FIG. 1). By installing the plate 8 at a proper height and angle of attack 18, the vortices 12 will come into scouring contact with the target surface 14 at a short distance downwind from the plate 8 and continue to travel in scouring contact with the surface until they dissipate.

Once a vortex 12 is in scouring contact with the target surface 14, it creates a localized increase in the surface tangent velocity 22. If the surface tangent velocity 22 exceeds the threshold velocity of the snow, localized surface sheer stresses are created which dislodge the snow from the target surface 14. The sheer stresses remove the snow from directly under the vortex 12 where it is entrained in the moving air column, and transported in the direction of the airflow 10 out of the target area 14. Depending on the strength of the vortex 12 and the velocity of the airflow 10, the snow will be redeposited at a distance downwind once the energy of the vortices 12 has dissipated to the point where it is no longer capable of carrying snow.

An array of many snow fences can be strategically positioned adjacent to a large target surface 14 to efficiently remove snow from large areas.

While in accordance of the provisions of the Patent Statutes, the preferred forms and embodiments of the invention have been illustrated and described, it will be apparent to those of ordinary skill in the art that various changes and modifications may be made without deviating from the inventive concepts set forth above.

What is claimed is:

1. A self-aligning vortex snow fence, comprising:

(a) a base including an upper portion rotatably connected to a lower portion; and (b) vortex producing means connected with said base upper portion for forming an airflow into a vortex and directing said vortex onto a target surface, said vortex producing means comprising a rigid triangular plate having two leading edges, a leading point formed at the intersection of said leading edges, a trailing edge, and a center of mass, said plate being connected with said base at an angle of attack so that said leading point is at a higher elevation than said trailing edge for generating vortices from an airflow which intersects the leading edges of said plate, said vortices propagating in the direction of the airflow beyond the trailing edge toward said target surface and thereafter continuing to travel in scouring contact with said target surface until dissipated to dislodge and remove snow from said surface.

2. An apparatus as defined in claim 1, wherein said triangular plate is mounted to said upper portion at said center of mass.

3. An apparatus as defined in claim 1, wherein said triangular plate is an equilateral triangle.

4. An apparatus as defined in claim 1, wherein said triangular plate is an isosceles triangle.

5. An apparatus as defined in claim 1, wherein said angle of attack is between 5–25° from perpendicular of said base.

6. An apparatus as defined in claim 1, wherein a plurality of self-aligning vortex snow fences are selectively positioned to produce a plurality of vortices, thereby removing snow from a larger target surface.

* * * * *